US012546213B2

(12) United States Patent
Nelson et al.

(10) Patent No.: US 12,546,213 B2
(45) Date of Patent: Feb. 10, 2026

(54) AUTONOMOUS ALONG STRING MEASUREMENT TOOL

(71) Applicant: NATIONAL OILWELL VARCO, L.P., Houston, TX (US)

(72) Inventors: Christian Nelson, Austin, TX (US); Swathi Murali, Austin, TX (US); Paul D. Koottungal, Cedar Park, TX (US); Anthony Durkowski, Round Rock, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 18/699,861

(22) PCT Filed: Sep. 28, 2022

(86) PCT No.: PCT/US2022/077149
§ 371 (c)(1),
(2) Date: Apr. 9, 2024

(87) PCT Pub. No.: WO2023/064678
PCT Pub. Date: Apr. 20, 2023

(65) Prior Publication Data

US 2024/0418081 A1 Dec. 19, 2024

Related U.S. Application Data

(60) Provisional application No. 63/262,364, filed on Oct. 11, 2021.

(51) Int. Cl.

| | |
|---|---|
| ***E21B 47/02*** | (2006.01) |
| ***E21B 47/022*** | (2012.01) |
| ***E21B 47/18*** | (2012.01) |

(52) U.S. Cl.
CPC ..... *E21B 47/18* (2013.01); *E21B 47/022* (2013.01)

(58) Field of Classification Search
None
See application file for complete search history.

(56) References Cited

U.S. PATENT DOCUMENTS

2005/0154532 A1 7/2005 Close et al.
2006/0220649 A1 10/2006 Martinez et al.
(Continued)

FOREIGN PATENT DOCUMENTS

WO WO-2023064678 A1 4/2023

OTHER PUBLICATIONS

"International Application Serial No. PCT/US2022/077149, International Search Report mailed Dec. 5, 2022", 2 pgs.
(Continued)

*Primary Examiner* — Alexander A Mercado
(74) *Attorney, Agent, or Firm* — Schwegman Lundberg & Woessner, P.A.

(57) ABSTRACT

An autonomous along string measurement tool may include a data collection and transmission system having a sensor configured to collect the downhole data, a communication tool configured to transmit the downhole data to the surface, and an operations processor configured for receiving downhole data from the sensor and controlling the communication tool to transmit the downhole data. The system may also include a power bus configured for supplying power to the data collection and transmission system, a power source in selective electrical communication with the power bus, and a power gateway. The power gateway may be configured to control the selective electrical communication between the power source and the power bus based on whether tool conditions are suitable for operation.

4 Claims, 7 Drawing Sheets

(56) References Cited

U.S. PATENT DOCUMENTS

| | | | |
|---|---|---|---|
| 2013/0027216 | A1 | 1/2013 | Jantz et al. |
| 2015/0292319 | A1 | 10/2015 | Disko et al. |
| 2021/0017856 | A1 | 1/2021 | Feddema et al. |
| 2022/0102750 | A1 | 3/2022 | Gwon et al. |

OTHER PUBLICATIONS

"International Application Serial No. PCT/US2022/077149, Written Opinion mailed Dec. 5, 2022", 5 pgs.
"Colombian Application Serial No. NC2024 0006014, Office Action mailed May 27, 2024", w English translation, 2 pgs.
"Australian Application Serial No. 2022361909, Voluntary Amendment filed May 14, 2024", 11 pgs.
"International Application Serial No. PCT US2022 077149, International Preliminary Report on Patentability mailed Aug. 13, 2024", 8 pgs.
"European Application Serial No. 22881906.6, Response to Communication pursuant to Rules 161 and 162 EPC filed Aug. 8, 2024", 10 pgs.
"Argentina Application Serial No. P220102750, Office Action mailed May 14, 2025", 3 pgs.
"European Application Serial No. 22881906.6, Communication pursuant to Rule 164(1) EPC mailed Jun. 4, 2025", 18 pgs.

AUTONOMOUS ALONG STRING MEASUREMENT TOOL

CLAIM OF PRIORITY

This patent application is a U.S. National Stage Filing under 35 U.S.C. 371 form International Application No. PCT/US2022/077149, filed on Sep. 28, 2022, which claims the benefit of priority to U.S. Provisional Application Ser. No. 63/262,364, filed Oct. 11, 2021, each of which are incorporated by reference herein in their entirety.

FIELD OF THE INVENTION

The present disclosure relates to an along string measurement (ASM) tool. More particularly, the present disclosure relates to an ASM tool adapted for autonomous startup operations. Still more particularly, the present disclosure relates to an ASM tool having an angle sensor adapted to trigger operation of the tool based on the tool's orientation relative to a planetary surface.

BACKGROUND OF THE INVENTION

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

Measurement while drilling (MWD) generally involves one or more tools arranged along a drill string that allow for capturing downhole information during drilling and/or tripping drill pipe. In some cases, MWD tools are placed at selected locations along the drill string and are adapted to provide support for directional drilling operations. Other along string measurement (ASM) tools may also be adapted to capture data relating to the downhole environment for logging while drilling (LWD) operations. For example, ASM tools may include temperature sensors, pressure sensors, gamma ray sensors, or other sensors. These sensors may allow for capturing wellbore data and/or data relating to the surrounding geological formations. In some cases, the ASM tool may measure density, porosity, resistivity, acoustic-caliper, inclination at the drill bit, magnetic resonance and/or formation pressure. The sensor measurements mentioned may be "pulsed" up to the earth surface using a mud pulse telemetry system to obtain real time data. The sensors may be encapsulated inside metal housings that can withstand drilling and environmental conditions.

ASM tools are often battery operated due to a lack of access to electrical power in the downhole environment. In some cases, the batteries may be designed to provide 200-300 hours of operational power. In view of the limited battery life, particularly trained crews may be present on site to assemble the ASM tool just in time for use as shown in FIG. 1. This crew may also insert the ASM tool inside a non-magnetic drill collar (NDMC) on the rig floor and perform an alignment such that the sensors inside the ASM tool are indexed from a physical attribute of a bottom hole assembly, for example. Given the nature of drilling operations, the mentioned crew may be on standby until their service is needed to assemble the ASM tools and the assembly may be performed in uncontrolled conditions subject to environmental conditions. This can be costly and may also increase exposure from a health, safety, and environmental (HSE) perspective.

BRIEF SUMMARY OF THE INVENTION

The following presents a simplified summary of one or more embodiments of the present disclosure in order to provide a basic understanding of such embodiments. This summary is not an extensive overview of all contemplated embodiments and is intended to neither identify key or critical elements of all embodiments, nor delineate the scope of any or all embodiments.

In one or more embodiments, an autonomous along string measurement tool may include a data collection and transmission system configured to collect downhole data and transmit the downhole data to a surface of a wellbore. The data collection and transmission system may include a sensor configured to collect the downhole data, a communication tool configured to transmit the downhole data to the surface, and an operations processor configured for receiving downhole data from the sensor and for controlling the communication tool to transmit the downhole data. The too may also include a power bus configured for supplying power to the data collection and transmission system, a power source in selective electrical communication with the power bus, and a power gateway. The power gateway may be configured to control the selective electrical communication between the power source and the power bus based on whether tool conditions are suitable for operation of the data collection and transmission system.

In one or more embodiments, a method of providing an along string measurement tool may include assembling an along string measurement tool at an offsite location. The assembling may include connecting a power source to a processor; and placing the along string measurement tool in a tubular at the offsite location. The method may also include conveying the along string measurement tool to a drill site. The method may also include installing the along string measurement tool in a drill string at the drill site. The method may also include using the along string measurement tool to capture and transmit downhole data.

In one or more embodiments, a method of operation for an along string measurement tool may include entering a sleep mode at a time of assembly and continually or periodically monitoring conditions of the along string measurement tool while in sleep mode. When a threshold is not met, the method may include maintaining the tool in sleep mode and, when a threshold is met, the method may include waking the tool up.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure, in one or more embodiments, relates to an autonomous along string measurement (ASM) tool that avoids the need for onsite assembly and, as such, may be placed within a drill collar and be ready for placement in the drill string well ahead of the time of its use. In particular, the autonomous ASM tool may be a smart tool that relies on physical orientation to trigger activation. For example, the tool may be a relatively elongate tool that generally remains in a relatively horizontal condition after assembly until it is ready for use, when it may be lifted into a relatively vertical position for placement on a drill string. The present autonomous ASM tool may, thus, rely on its physical orientation to stay turned off or asleep unless/until the tool is lifted into a near vertical position when the tool may turn on or wake up, so to speak. In this manner, assembly may occur in the controlled environment of a workshop, the battery life of the tool may be conserved during storage, shipping, and staging, and the need for an onsite crew for just-in-time assembly may be avoided.

Figure 1:
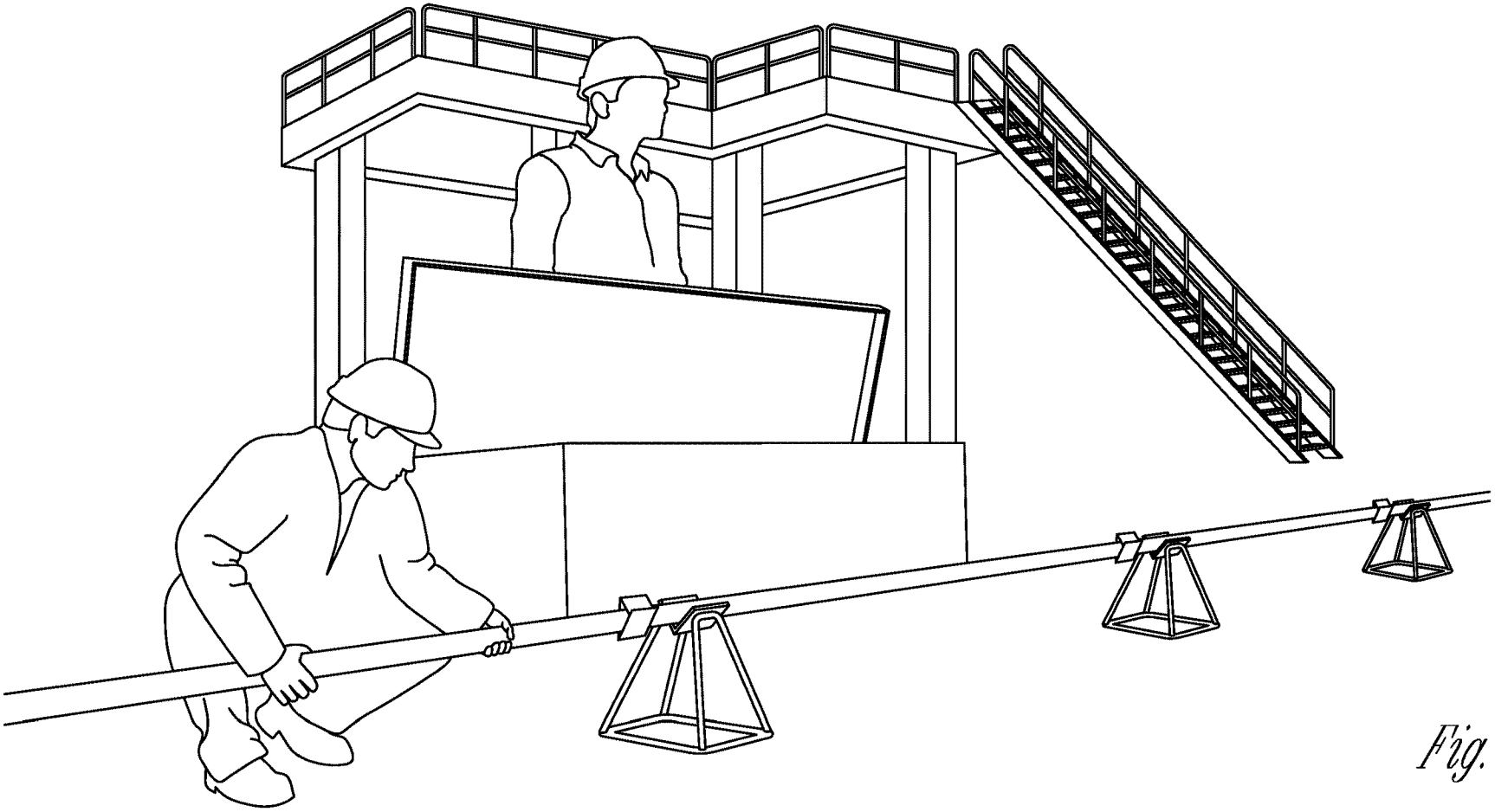
FIG. 1 is prior art perspective view of a particularly trained crew assembling an along string measurement (ASM) tool onsite just in time for use.
Figure 2:
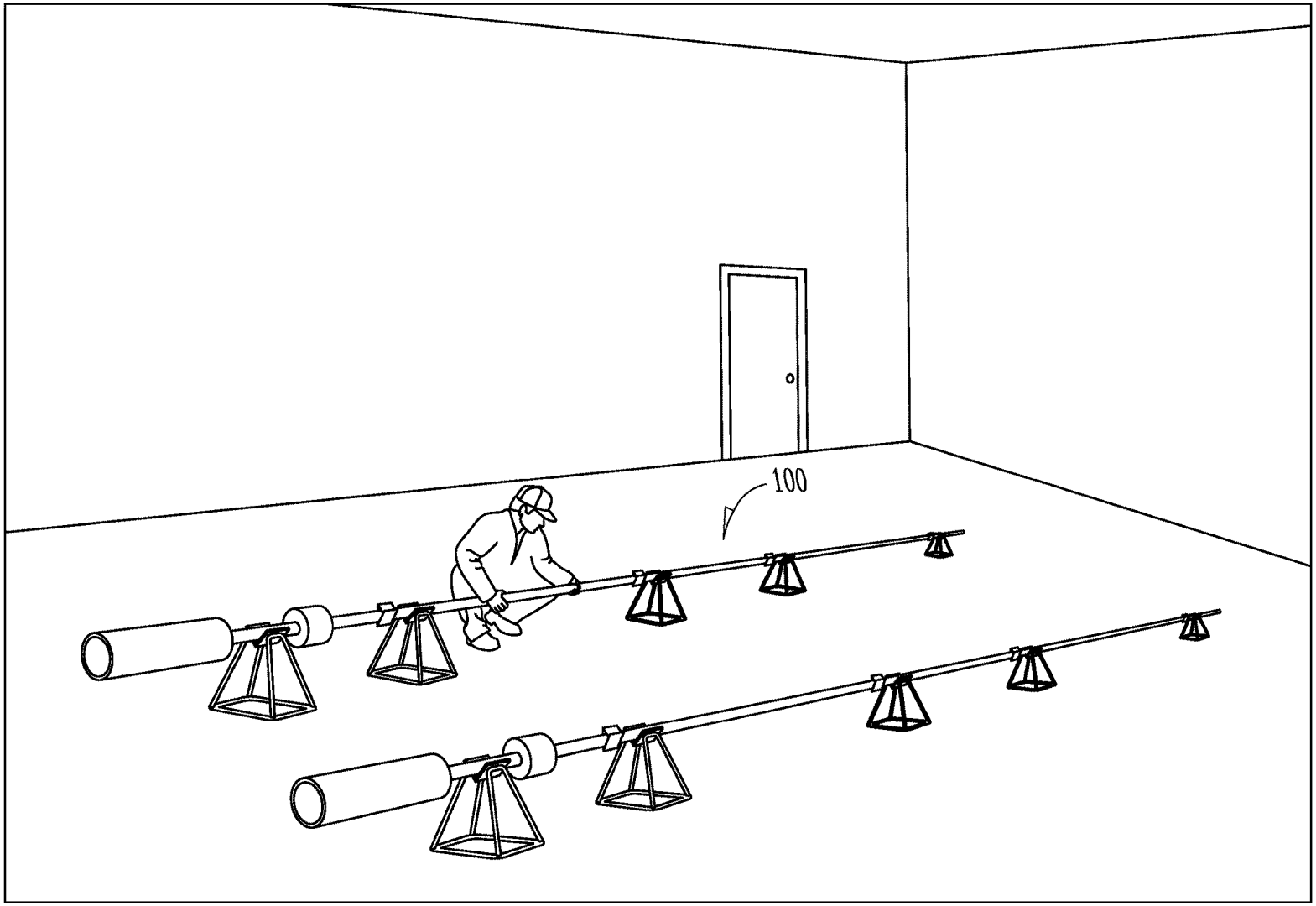
FIG. 2 is a perspective view of workshop personnel assembling an autonomous ASM tool in a workshop well ahead of a time of its use and distant from its location of use, according to one or more embodiments.
Figure 3:
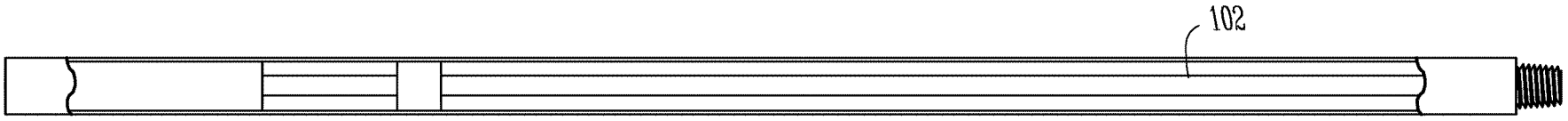
FIG. 3 is a perspective cross-sectional view of the assembled autonomous ASM tool in place in a tubular such as drill pipe or drill collar, according to one more embodiments.

FIG. 2 shows the ASM tool 100 in an assembly area in a workshop prior to placement within a tubular such as a drill pipe or a drill collar, for example. As shown, the tool 100 may be an elongate system of devices and sensors adapted to capture and relay information to a drilling operator via a mud pulsing telemetry system, for example. In this particular case, a primary ASM tool 100 and a backup ASM tool are being assembled. To protect the sensitive sensors and to make the sensor system suitable for placement in the drill string, the tool 100 may be placed within a drill pipe, drill collar, or other tubular 102 that is adapted to be connected end to end with other aspects of the bottom hole assembly or other aspects of the drill string. FIG. 3 shows the ASM tool 100 arranged within the tubular 102 and adapted for placement in a drill string.

Figure 4:
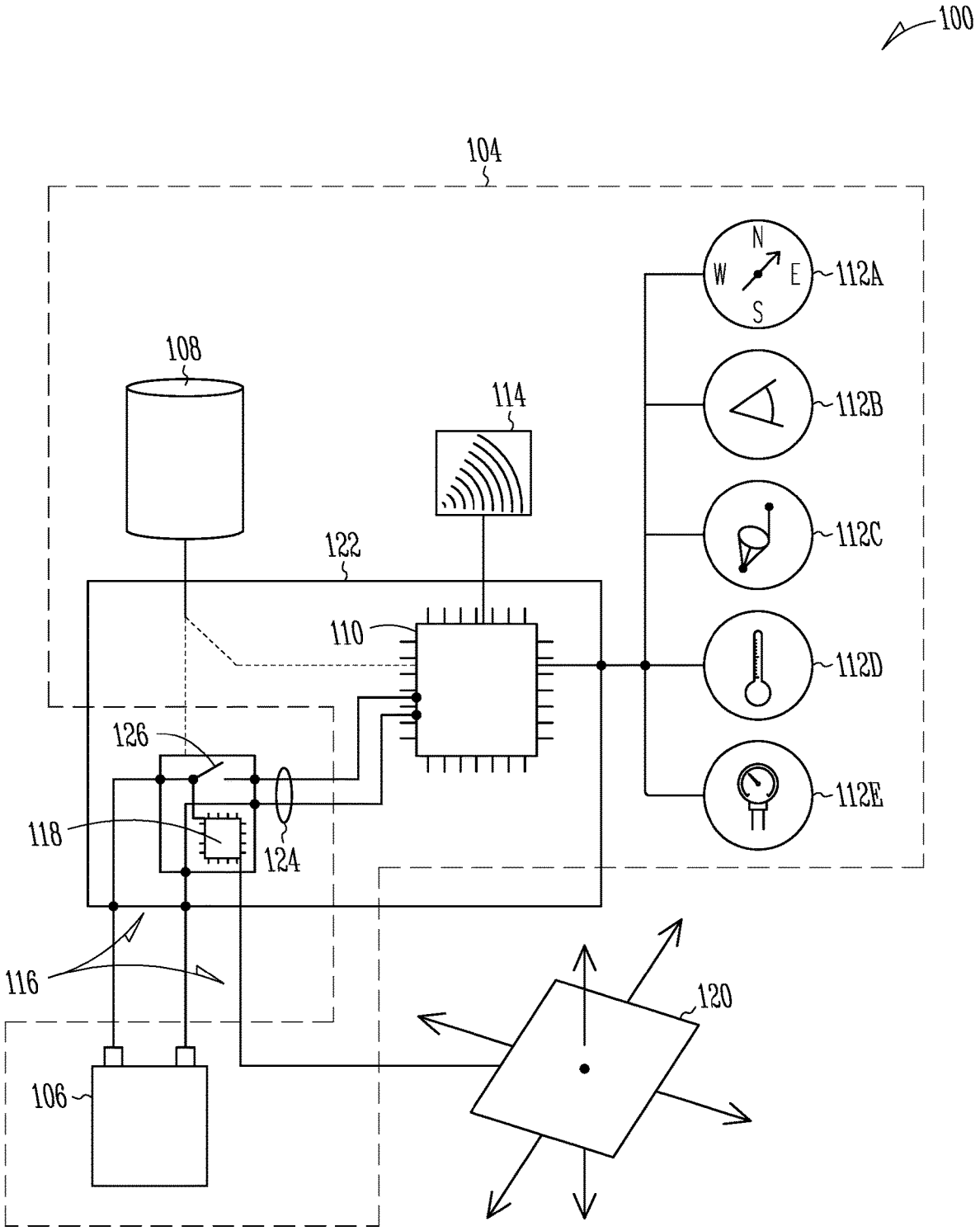
FIG. 4 is a schematic diagram of the autonomous ASM tool, according to one or more embodiments.

As shown schematically in FIG. 4, the ASM tool 100 may include a data collection and transmission system 104 configured to collect downhole data and transmit the data to a surface of a wellbore in which the ASM tool 100 is arranged. For example, the ASM tool 100 may be adapted for directional drilling or other measurement while drilling (MWD) operations and/or the ASM tool may be adapted for collecting downhole formation data or may perform other logging while drilling (LWD) operations. Still other control and/or data collection operations may be provided by the ASM Tool 100. The data collection and transmission system 104 may include a power source 106, a computer readable storage medium 108, an operations processor 110, one or more sensors 112A-E, and a communication tool 114. Integrated into that system or separate from that system, the ASM tool 100 may include a power gateway 116 configured for controlling the flow of power to the data collection and transmission system 104. The power gateway 116 may include a power control processor 118, a computer readable storage medium, which may be part and parcel with medium 108 or separate from medium 108, and an orientation sensor 120. The several parts of the system may be addressed in turn.

The power source 106 may include a battery, for example. The battery may be adapted to provide power to the system and may be designed and sized to provide 100-500 hours, 150-450 hours, or about 200-300 hours of power to the ASM tool 100. In one or more embodiments, the battery may include a lithium ion or lithium thionyl chloride battery pack, for example. The battery may be in selective electrical communication with the operations processor 110 to provide power to the operations processor 110 and to the remaining aspects of the system. As discussed in more detail below, the power gateway 116, which may be part of an overall processing unit 122 or separate from the processing unit 122 may control power to the operations processor 110. In particular, a power bus 124 may selectively receive power from the battery based on control by the power gateway 116. That is, for example, the power gateway 116 may control a switch or other electrical component 126 that prevents or allows power to flow to the operations processor 110, 124, sensors 112A-E, and communication tool 114 via a power bus 124 only after particular conditions have occurred.

The computer readable storage medium 108 may be configured for storing computer readable instructions for execution by the processing unit 122 or separately by the operations processor 110 and the power control processor 118. For example, the computer readable instructions may include instructions for the operations processor 110 to operate the sensor or sensors 112A-E that are part of the data collection and transmission system 104. For example, the instructions may include power on/off instructions for the sensors 112A-E and instructions for receiving and storing data received from the sensors 112A-E. In other circumstances, the sensors 112A-E may power on when the power bus 124 receives power and the computer readable instructions may more simply involve instructions for receiving data and/or storing data from the sensors. The computer readable instructions may also include instructions for the operations processor 110 to operate the communication tool 114 for transmitting data to the surface of the wellbore (e.g., to the drilling rig). In one or more embodiments, the computer readable storage medium 108 may also include computer readable instructions for the power gateway 116 or the computer readable instructions for the power gateway 116 may be separately stored. The instructions for the power gateway 116 may include instructions for periodically awakening and for operating the orientation sensor (e.g., powering it on and receiving data therefrom) to determine if it is appropriate to power up the remaining aspects of the system. The methods associated with the power gateway are discussed in greater detail below.

The processing unit 122 or, separately, the operations processor 110 and the power control processor 118 may be configured for executing the computer readable instructions stored on the computer readable storage medium 108. In particular, the operations processor 110 may be adapted for operating the one or more sensors 112A-E and/or the communication tool 114. With respect to the one or more sensors 112A-E, the processor may control the on/off state of one or more of the sensors and may be configured to capture and store data generated by the one or more sensors. The processor may also control the communication tool to transmit sensor data to the wellbore surface. The operations processor 110 may include a computing chip, circuit, microcontroller or other processing device adapted to execute the computer readable instructions relating to sensor operation and communication tool operation. Example operations processors 110 for managing the several sensors 112A-E and the communication tool 114 may include a field-programmable gate array (FGPA), a reduced instruction set computing (RISC) architecture such as an advanced RISC machine (ARM) processor or a microchip peripheral interface controller (PIC). As shown, the processing unit 122 may include a power control processor 118 as part of the power gateway 116. The power control processor 118 may be adapted to control a switch or other device 126 that controls power running to the operations processor 110, the sensors 112A-E, and the communication tool 114 via a power bus 124. The power control processor 118 may control that power based on orientation information from an orientation sensor 120. As such, the power control processor 118 may be further adapted for operation of the orientation sensor 120 by powering the orientation sensor 120 on and off and capturing, storing, and/or processing information received from the orientation sensor 120. For example, and as discussed in more detail below, the power control processor 118 may process accelerations from an orientation sensor 120 to establish an angular orientation and may compare the angular orientation to a threshold angle, for example. Depending on the relationship of the angular orientation to the threshold, the power control processor 118 may establish electrical communication between the power source 106 and the power bus 124 to allow operation of the operations processor 110 or may continue to limit/prevent power to the operations processor 110 and other aspects of the system. The power control processor 118 may include a computing chip, circuit, microcontroller, or other processing device adapted to execute the computer readable instructions relating to switch or power control. Example power control processors for controlling the power gateway may include an FGPA, an ARM processor, or a microchip PIC. It is to be appreciated that, while the power control processor 118 is shown as being part of an overall processing unit 122, the power control processor 118 may be provided separately.

The one or more sensors 112A-E of the ASM tool 100 may be adapted to capture data about drilling operations or the surrounding environment, for example. In one or more embodiments, the one or more sensors 112A-E may include a directional sensor or sensors 112A/B, a gamma ray detection sensor 112C, a temperature sensor 112D, a pressure sensor 112E, or other sensors may be provided. The directional sensor or sensors 112A/B may assist with directional drilling and, as such, may capture orientation and direction information. The directional sensor or sensors 112A/B may include magnetometers, gyroscopes, and/or accelerometers adapted to capture orientation information during drilling. Gamma ray detection sensors 112C may be adapted to capture or measure gamma rays emitted by rock or sediment. Temperature sensors 112D may measure the temperature of the wellbore or surrounding rock or sediment and pressure sensors 112E may measure internal and/or external pressures of the drill string, for example. Still other types of sensors may be provided.

The communication tool 114 may be configured for transmitting information captured by the sensors 112A-E to the wellbore surface (e.g. to the drill rig operator). In one or more embodiments, the communication tool 114 may include a mud pulsing tool adapted to codify and transmit sensor data via mud pulses through the drilling mud surrounding or within the drill string. In one or more embodiments, the communication tool 114 may include a transmitting element the ASM Tool 100 and a receiving element on the drill rig, for example. Still other types of communication tools may be provided, such as Electro-Magnetic (EM) telemetry.

The orientation sensor 120 may be configured for sensing the orientation of the tool 100 in a relatively low power environment. In one or more embodiments, the orientation sensor 120 may be a single axis accelerometer, dual axis accelerometer, or a 3-axis accelerometer, for example. The orientation sensor 120 may be powered on or off by the power control processor 118 and may provide data to the power control processor 118 for assessing whether to power up the tool 100 or remain unpowered, for example. In one or more embodiments, the orientation processor 120 may include a tilt or micro-electromechanical system (MEMS) accelerometer.

Figure 5:
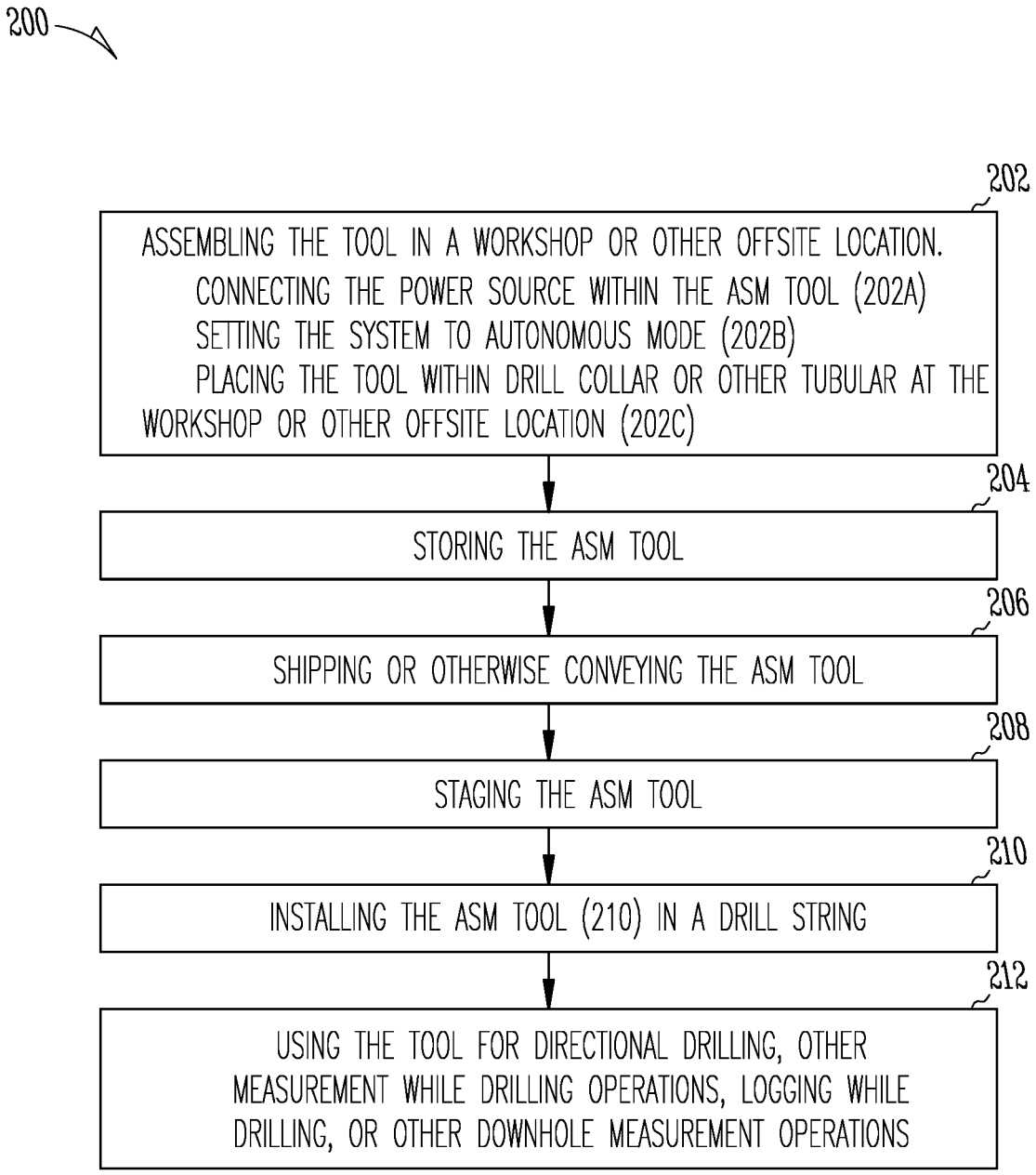
FIG. 5 is a diagram depicting a method of providing an autonomous ASM tool, according to one or more embodiments.

In operation and use, the ASM tool 100 may be used to support directional drilling operations, other measurement while drilling operations, logging while drilling operations or other downhole operations. As shown in FIG. 5, a method 200 of providing an ASM tool 100 may include assembling the tool 100 in a workshop or other offsite location. (202) Offsite in this context may mean a site separated from the drill site by a shipping distance, for example. That is, offsite does not include a neighboring site or staging area near the drill site, but instead a distance of many miles suitable for travel by a commercial tractor trailer hauling the ASM tool 100. The assembly may include connecting the power source within the ASM tool 100 (202A) by, for example, placing the power source in electrical communication with the processing unit 122 or the power control processor 118 and allowing the tool 100 to manage the power consumption. In one or more embodiments, the assembler may set the system to autonomous mode (202B) where, for example, the tool has an option of running autonomously or non-autonomously. The assembly may also include placing the tool within drill collar or other tubular at the workshop or other offsite location (202C). The method of use may include storing the ASM tool (204) in a substantially horizontal condition, shipping or otherwise conveying the ASM tool (206) in a substantially horizontal condition, and staging the ASM tool (208) onsite in a substantially horizontal condition. Horizontal in this context may include any orientation sufficient to avoid triggering operation of the tool. The method may also include installing the ASM tool (210) in a drill string and using the tool (212) for directional drilling, other measurement while drilling operations, logging while drilling, or other downhole measurement operations. Notably, no assembly or alteration of the tool at the drill site may be required with this method. That is, complete assembly of the ASM tool may be performed at the offsite location and the ASM tool may arrive at the drill site ready for use and needing no further intervention by personnel to connect power, to place the tool within a tubular, or to otherwise access the inner workings of the tool. More simply the tool may be ready for use and may be picked up and placed in the drill string. As such, the installing step above may be very seamless saving time and cost.

Figure 6:
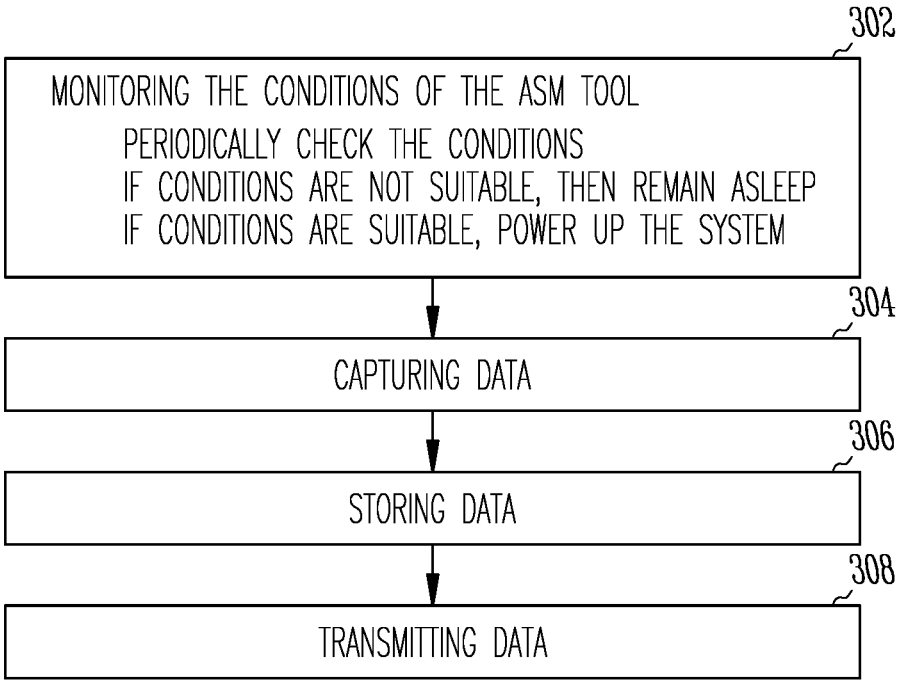
FIG. 6 is a diagram depicting a method of operation of an autonomous ASM tool, according to one or more embodiments.

Referring now to FIG. 6, a method of operation 300 may be provided. The method 300 may include controlling power consumption by the ASM tool unless/until conditions are suitable for use. That is the method may include monitoring conditions of the ASM tool (302). For example, the system may periodically check the conditions of the ASM tool by, for example, checking the orientation of the tool. When condition are not suitable, the system may remain asleep and periodically recheck the conditions, remaining asleep unless/until conditions are suitable. When conditions for use become suitable, the system may power on and begin capturing data (304), storing data (306), and/or transmitting data (308). The details of monitoring the conditions of the ASM tool are discussed in more detail below with respect to FIG. 7. Regarding the other method steps, capturing data (304) may include capturing data with one or more sensors and receiving the data at a processor. For example, directional data may be captured to support directional drilling. Capturing data may also include detecting gamma rays from rock or sediment surrounding the well bore. Capturing data may also include sensing pressures in the wellbore or within the drill string. Capturing data may also include sensing temperatures of the wellbore or the drill fluid in the wellbore or within the drill string. Still other types of data may be captured, stored, and/or transmitted to the surface or the drill rig. Storing the data (306) may include the processor storing the data in the computer readable storage medium and/or temporarily storing the data for transmission, such as in random access memory, for example. Transmitting the data (308) may include operating the communication tool 114 with a processor to transmit the data. For example, the communication tool 114 may include a mud pulsing telemetry system and transmitting the data may include codifying the data and transmitting mud pulses within the wellbore for receiving by a receiver and decoding, for example.

Figure 7:
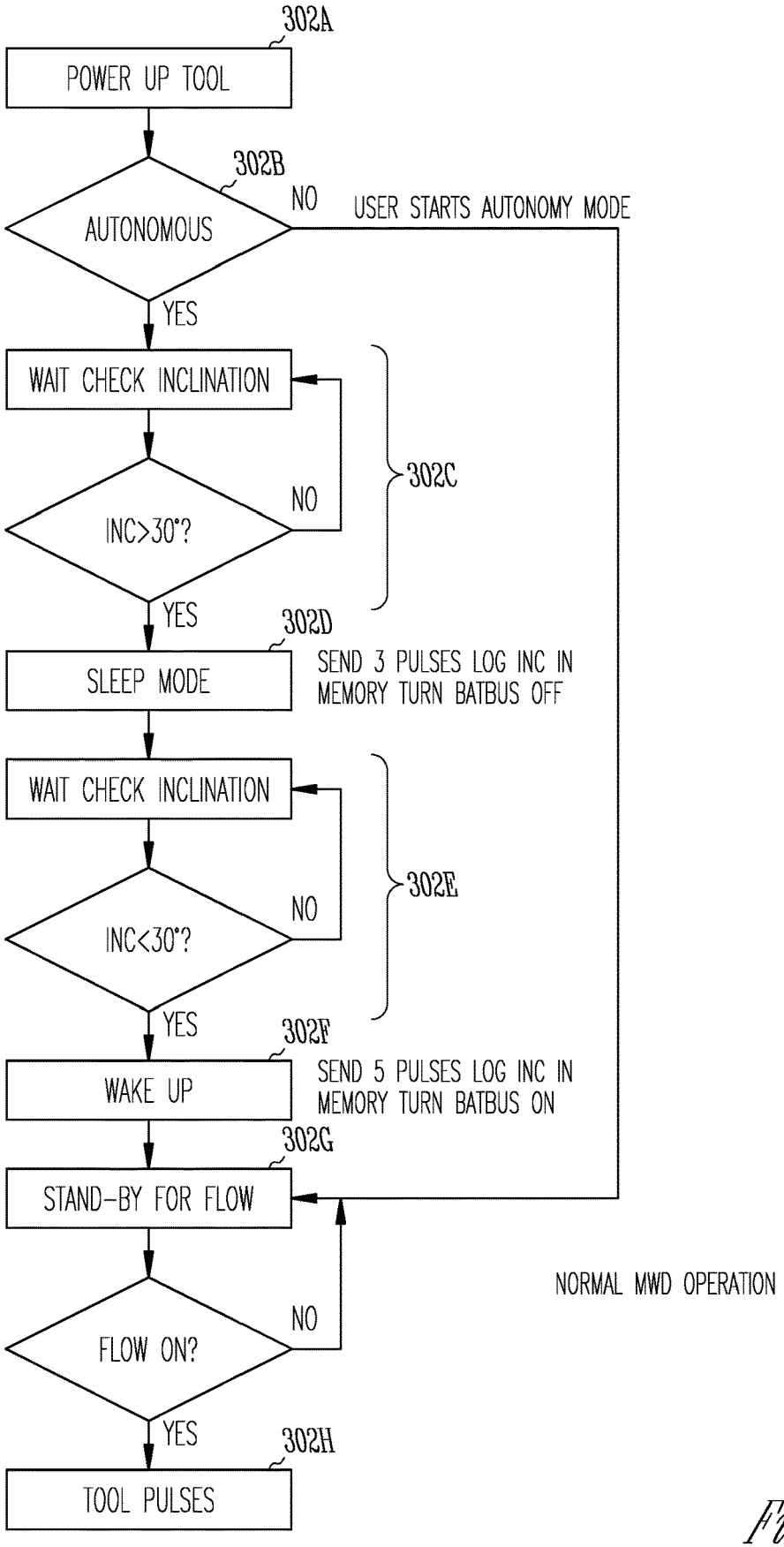
FIG. 7 is a flowchart depicting operations surrounding a sleep state of the autonomous ASM tool, according to one or more embodiments.

With reference now to FIG. 7, the details of monitoring the conditions of the ASM tool (302) may be described in more detail. As shown, and during the setup process, the assembler may power up the tool (302A) and if the tool has an option for autonomous mode, the assembler may provide an input via an user interface to place the tool in autonomous mode. If this is not done, the tool may begin operating and standing by for fluid flow (302G). This may be appropriate, for example, if an autonomous capable tool is sent to a drill site without being fully assembled. However, when performing operations at an offsite location, the assembler may select autonomous mode in the interface.

In view of the above, when the tool is powered up, the tool may check to see if the tool is in autonomous mode or not (302B). That is, as shown, where the tool is set to autonomous mode or otherwise is designed only for autonomous mode the system may perform an initial inclination check (302C) to make sure the tool assembly is as anticipated. That is, the initial inclination check may be anticipated to be substantially horizontal and if it is not, the system may loop until proper installation is achieved. If proper installation has occurred and the tool senses that it is substantially horizontal, the tool may enter sleep mode (302D), which may include sending an indicator to the assembler that sleep mode is being entered, and the battery bus may be turned off. In one or more embodiments, the indicator may include a series of pulses such as three pulses or a light indicator, flashing light, sound, vibration, or other indication may be provided. The inclination check may include a threshold ranging from 10-50 degrees, 20-40 degrees, or 30 degrees from vertical. That is, for example, in the case of a 30 degree threshold, a tool that is arranged at 45 degrees or another angle extending up to 59 degrees from horizontal may be considered to be "horizontally" arranged. As such, and again with a 30 degree threshold, to be considered vertically arranged as discussed in more detail below, the tool may need to be relatively upright and only vary between-30 and 30 degrees from vertical.

Sleep mode may include a series of timed or periodic checks to see if the tool orientation has changed such that full operational mode of the tool may be provided (302E). As shown, the inclination checks here may check to see if the inclination is less than 30 degrees from vertical meaning that the tool is in a substantially upright condition. While a 30 degree threshold is shown, the range may be from 10-50 degrees, or from 20-40 degrees, or a 30 degree threshold may be provided. Where the threshold is not met (e.g., the inclination from vertical is not less than 30 degrees, but instead is more than 30 degrees from vertical), the tool may be considered substantially horizontal and the tool may remain in sleep mode. However, where the threshold is met (e.g., the inclination from vertical is less than 30 degrees) the tool may wake up (302F) by turning on the battery bus. In one or more embodiments, an operator indicator may be provided such as by providing a pulse, a series of pulses, a light indication, a sound, vibration, or another indicator. In the woken up or turned on condition, the sensors may be active and data may begin to be collected by the processor. On the other hand, the communication tool 114 may remain in standby mode (302G) unless/until there is flow of drilling fluid. Upon commencement of the flow of drilling fluid, the communication tool 114 may begin sending data communications by pulsing the drilling fluid (302H). It is to be appreciated that where the assembler places the tool in non-autonomous mode, the initialization steps, the sleep state and inclination checks may all be skipped by the system and the system may go straight to powered on with an indicator to the operator that it is on and the communication tool may be in standby mode. As such, while an autonomous operation may be provided, an onsite activation may be provided as well.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. An autonomous along string measurement tool, comprising:

a data collection and transmission system configured to collect downhole data and transmit the downhole data to a surface of a wellbore, the data collection and transmission system comprising:

a sensor configured to collect the downhole data;

a communication tool configured to transmit the downhole data to the surface; and an operations processor configured for receiving downhole data from the sensor and controlling the communication tool to transmit the downhole data to the surface; and a power bus configured for supplying power to the data collection and transmission system;

a power source in selective electrical communication with the power bus; and a power gateway configured to control the selective electrical communication between the power source and the power bus and comprising a power control processor configured to:

maintain the tool in a sleep mode unless the tool is arranged in a substantially upright condition; and when the tool is placed in the substantially upright condition and due to the placing in the substantially upright condition, the power control processor places the power source in electrical communication with the power bus.

2. The tool of claim 1, wherein the power gateway comprises an orientation sensor.

3. The tool of claim 2, wherein the power control processor is configured to receive orientation data from the orientation sensor.

4. The tool of claim 3, wherein the power control processor is configured to determine if the tool is substantially upright based on the orientation data, wherein the tool is substantially upright when the orientation data includes an angle of inclination less than 30 degrees from vertical.

* * * * *